US007108541B2

(12) United States Patent
Chiba et al.

(10) Patent No.: US 7,108,541 B2
(45) Date of Patent: Sep. 19, 2006

(54) PRESS-CONTACTING TERMINAL APPARATUS

(75) Inventors: Shingo Chiba, Haibara-gun (JP); Haruyuki Matsushita, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/111,795

(22) Filed: Apr. 22, 2005

(65) Prior Publication Data

US 2005/0272300 A1 Dec. 8, 2005

(30) Foreign Application Priority Data

Jun. 2, 2004 (JP) ..... P2004-164838

(51) Int. Cl.
*H01R 4/24* (2006.01)
*H01R 4/26* (2006.01)
*H01R 11/20* (2006.01)

(52) U.S. Cl. ..... 439/405

(58) Field of Classification Search ..... 439/397, 439/399, 401, 403, 405
See application file for complete search history.

(56) References Cited

U.S. PATENT DOCUMENTS 4,039,240 A * 8/1977 Peterson ..... 439/401
5,415,562 A * 5/1995 Matsumoto et al. ..... 439/397
2005/0272300 A1* 12/2005 Chiba et al. ..... 439/405

FOREIGN PATENT DOCUMENTS

JP 2000-067942 A 3/2000
JP 2001-155796 A 6/2001

* cited by examiner

*Primary Examiner*—James R. Harvey
(74) *Attorney, Agent, or Firm*—Sughrue Mion, PLLC

(57) ABSTRACT

A press-contacting terminal includes a bottom plate, and press-contacting blades each projecting from the bottom plate and having a wire insertion portion formed therein. When a wire is forced into the wire insertion portion, the press-contacting terminal cuts a sheath of the wire, and is electrically connected to an exposed conductor of the wire. A chamfered portion is formed at an outer side portion of each press-contacting blade, and when the wire is forced into the wire insertion portion, the chamfered portion mainly receives a stress from the wire so as to prevent the press-contacting blade from tiling outwardly.

10 Claims, 4 Drawing Sheets

PRESS-CONTACTING TERMINAL APPARATUS

BACKGROUND OF THE INVENTION

This invention relates to a press-contacting terminal having press-contacting blades that are electrically connected to a conductor of a wire when the wire is pressed into the press-contacting blades.

There is known one related press-contacting terminal, in which when wires are mounted on a housing, an interconnecting portion and wire holding projections receive a stress, acting on the wire, so that the stress will not act directly on a press-contacting portion of the press-contacting terminal (see, for example, Patent Literature 1).

In the press-contacting terminal disclosed in Patent Literature 1, the wires are interconnected by the interconnecting portion, and the wire holding projections on a cover are fitted respectively in openings formed in the interconnecting portion, and with this construction a stress tending to pull the wire from a press-contacting connector, is received by the wire holding projections and the interconnecting portion, and therefore will not act directly on the press-contacting portion.

There is known another related press-contacting terminal in which an escape recess, corresponding to a wire installation path, is formed in a first press-contacting terminal clamp (see, for example, Patent Literature 2).

In the press-contacting terminal disclosed in Patent Literature 2, wires are press-contacted with predetermined press-contacting blades, and therefore are connected together by the press-contacting terminal in a predetermined pattern. In the press-contacting operation, first, one of two wires, jointly forming a first twisted wire, is press-contacted to an upper press-contacting blade of a first press-contacting terminal, and also the other wire is press-contacted with an upper press-contacting blade of a second press-contacting terminal. At this time, the first press-contacting terminal is disposed across a wire installation path that is to be connected to the second press-contacting terminal. However, an escape recess, corresponding to the wire installation path, is formed in the first press-contacting terminal, and therefore the wire, press-contacted with the second press-contacting terminal, will not interfere with the first press-contacting terminal.

There is known a further related press-contacting terminal in which tilt prevention projections are formed respectively at opposite sides of a press-contacting blade, and the press-contacting blade is kept spaced from its adjoining press-contacting blade, and is prevented from tilting into contact with the adjoining press-contacting blade.

There is known a still further related press-contacting terminal in which an inner portion of a press-contacting blade is chamfered, thereby preventing the press-contacting blade from tilting.

Patent Literature 1: JP-A-2000-067942 (Pages 3 to 5, FIG. 19)

Patent Literature 2: JP-A-2001-155796 (Pages 3 to 4, FIG. 1)

However, in the above Patent Literature 1, the wire holding projections on the cover prevent a stress from acting directly on the press-contacting portion, and therefore the cover is complicated in construction.

In the above second Patent Literature 2, the escape recess is formed in the press-contacting terminal, and this terminal is complicated in construction.

In the case where the tilt prevention projections are formed at the opposite sides of the press-contacting blade, this construction is against a space-saving design because of the provision of these tilt prevention projections, and therefore it is difficult to achieve a compact design.

In the case where the inner portion of the press-contacting blade is chamfered, it is necessary to provide tilt prevention projections, and besides for example, in the case where a flat cable is press-contacted with the press-contacting terminal, a bridge portion of the flat cable must be stamped, and therefore the efficiency of the operation is low.

FIG. 5 shows the case where a front (in FIG. 5) press-contact terminal 80 is disposed close to a rear (in FIG. 5) press-contacting terminal 81, and when two wires 83 and 84 of a flat cable 82 are to be press-contacted respectively with the two press-contacting terminals 80 and 81, the flat cable 82 is moved downward, and a press-contacting blade 85 of the front press-contacting terminal 80 is deformed inwardly by a stress from one wire 83, while a press-contacting blade 86 of the rear press-contacting terminal 81 is deformed inwardly by a stress from the other wire 84. Therefore, there is a fear that the two press-contacting blades 85 and 86 contact each other, so that the short-circuiting occurs therebetween.

SUMMARY OF THE INVENTION

This invention has been made in view of the above circumstances, and an object of the invention is to provide a press-contacting terminal apparatus that performs a self-tilt prevention function without the need for a complicated structure.

(1) A press-contacting terminal apparatus for press-contacting a wire that includes a conductor and a sheath for covering the conductor, the press-contacting terminal apparatus comprising:

a bottom plate; and a pair of press-contacting blades that projects from opposite side edges of the bottom plate to be opposed to each other, at least one of the pair of press-contacting blades including, a pair of blade portions that are elongated side by side so as to define a wire insertion portion therebetween, into which the wire is inserted and electrically connected to the conductor, a blade surface that is formed at a distal portion of the blade portion, and cuts the sheath when the wire is inserted into the wire insertion portion, and a chamfered portion that is formed at an outer portion of the blade surface positioned outside with respect to the bottom plate.

(2) The press-contacting terminal apparatus according to (1), wherein the distal portions of the pair of blade portion are inclined so as to form a V-shape to receive the wire.

(3) The press-contacting terminal apparatus according to (1), wherein the chamfered portion is inclined with respect to the blade surface and the blade portion.

(4) The press-contacting terminal apparatus according to (1), wherein when the blade surface cuts the sheath at the time the wire is inserted into the wire insertion portion, the chamfered portion prevents the press-contacting blade from tilting outwardly.

(5) The press-contacting terminal apparatus according to (1) further comprising:

a casing that includes a terminal fixing portion on which a plurality of press-contacting terminals are disposed, and a rib that is provided to the terminal fixing portion so as to prevent the wires, which are respectively inserted into the wire insertion portions, from interfering with each other.

(6) The press-contacting terminal apparatus according to (5), wherein the rib is formed at an end portion of the terminal fixing portion.

(7) The press-contacting terminal apparatus according to (6), wherein the rib is formed at a portion of the terminal fixing portion between the wire insertion portions.

(8) The press-contacting terminal apparatus according to (1) further comprising:

a casing that includes a terminal fixing portion on which the press-contacting terminal is disposed; and a cover that is mounted on the terminal fixing portion so as to press the wire to the press-contacting blade.

In the press-contacting terminal apparatus of the invention, when the wire is to be forced into the wire insertion portion of the press-contacting blade, the wire abuts against the chamfered portion, and therefore the chamfered portion mainly receives a stress from the wire, thereby preventing the press-contacting blade from tilting outwardly. Therefore, even when a plurality of press-contacting terminals are arranged close to each other, the adjacent press-contacting terminals will not contact each other. And besides, the press-contacting terminal prevents the tilting by itself upon press-contacting of the wire, and therefore it is not necessary to form any projection or the like. Thus, the press-contacting terminal can perform the self-tilt prevention function without the need for a complicated structure.

In the press-contacting terminal apparatus of the invention, when the wires are forced into the wire insertion portions of the press-contacting blades of the press-contacting terminals mounted on the terminal fixing portion, the rib prevents the wires from interfering with each other, and the wires are passed through the wire insertion portions separately from each other. As a result, the interference of the wires with each other is prevented.

In the press-contacting terminal apparatus of the invention, there is achieved an advantage that it does not need to have any tilt prevention rib, and can perform the self-tilt prevention function without the need for a complicated structure.

DETAIL DESCRIPTION OF PREFERRED EMBODIMENTS

Figure 1:
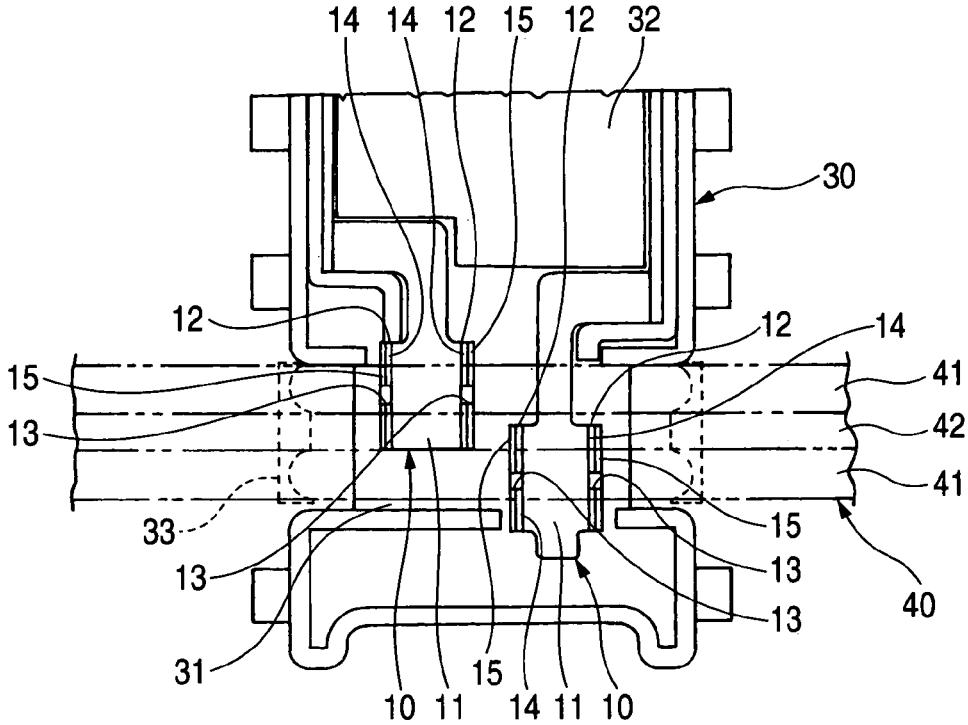
FIG. 1 is a plan view showing a condition in which one preferred embodiment of press-contacting terminals of the present invention are mounted within a casing.
Figure 2:
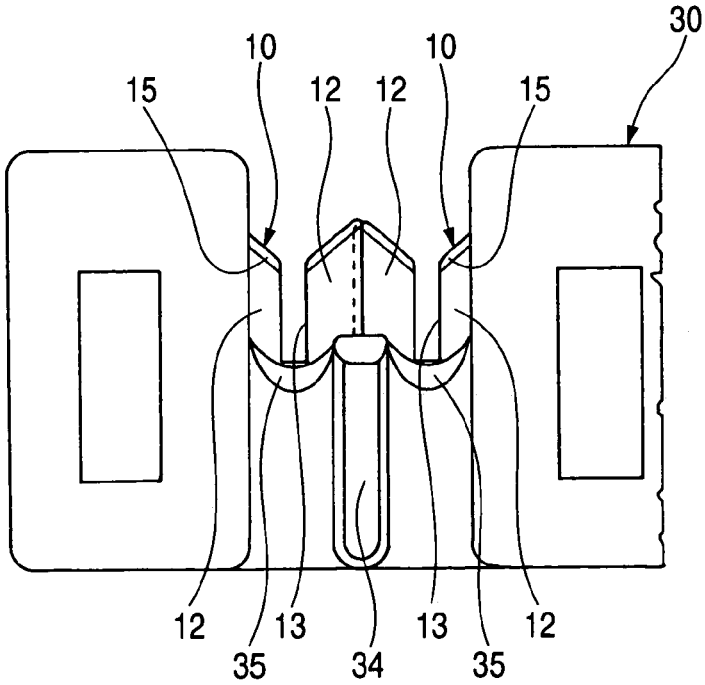
FIG. 2 is a side-elevational view of FIG. 1.
Figure 3:
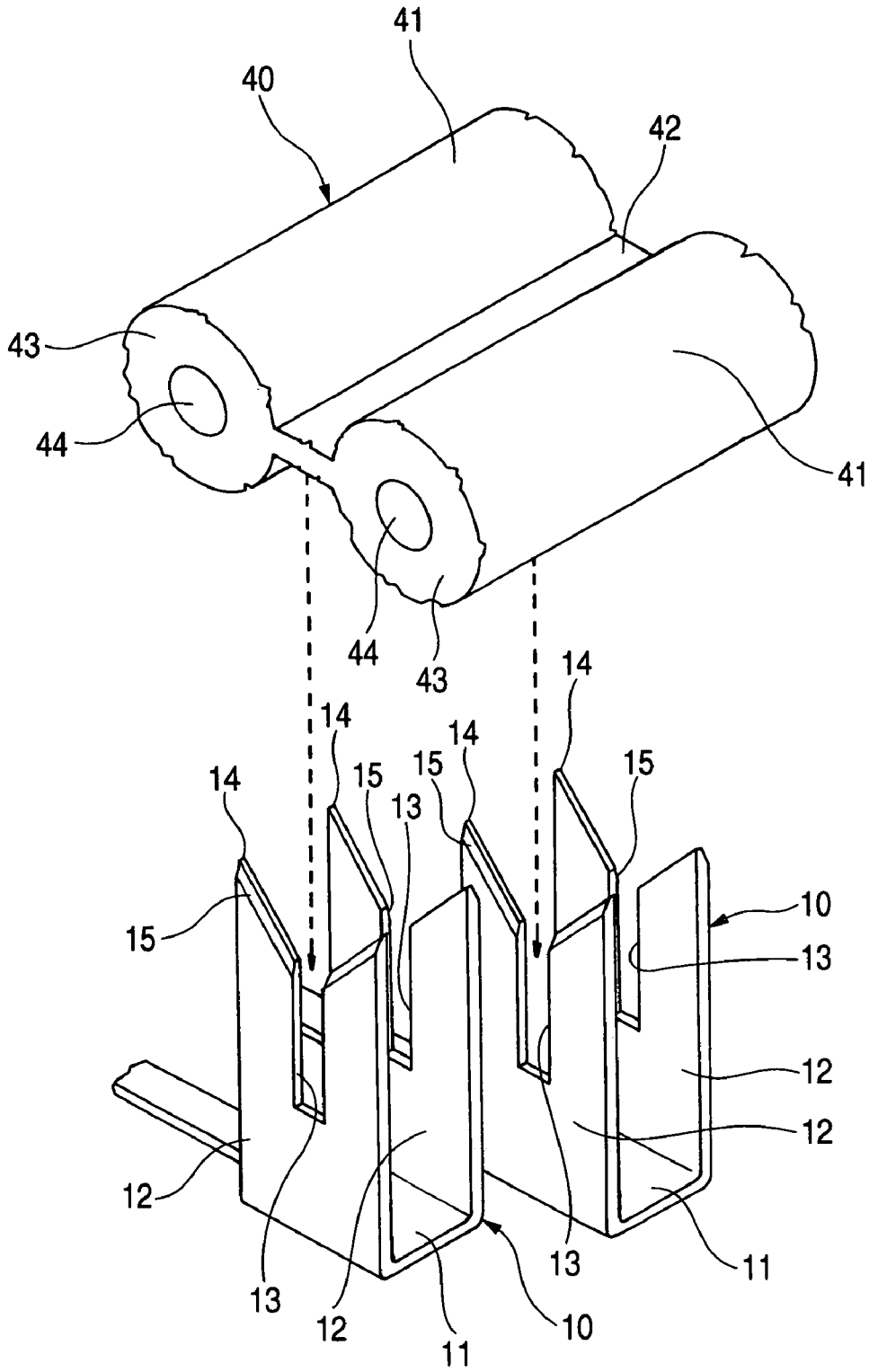
FIG. 3 is a perspective view of the press-contacting terminals of FIG. 1, showing their appearance.
Figure 4:
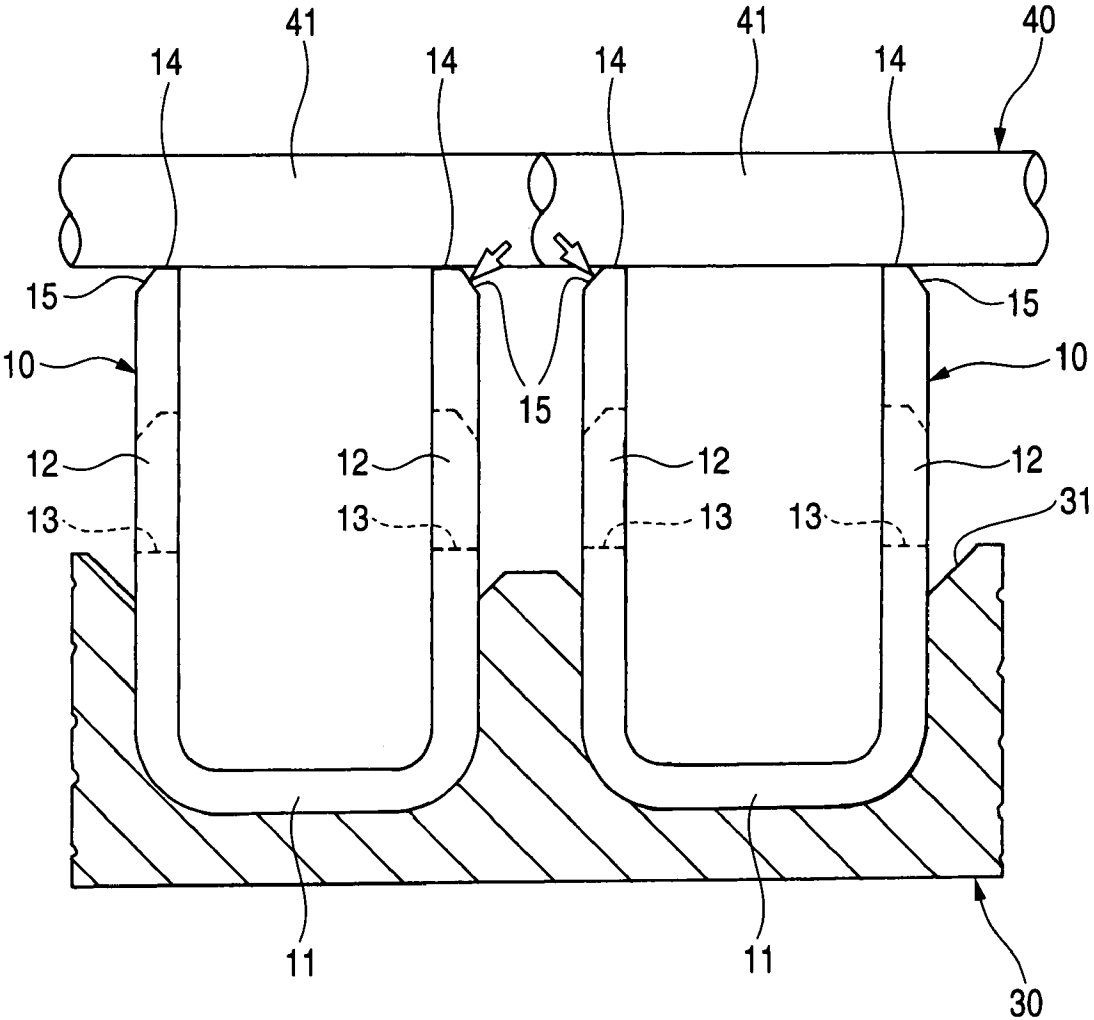
FIG. 4 is a front-elevational view of the press-contacting terminals of FIG. 3.
Figure 5:
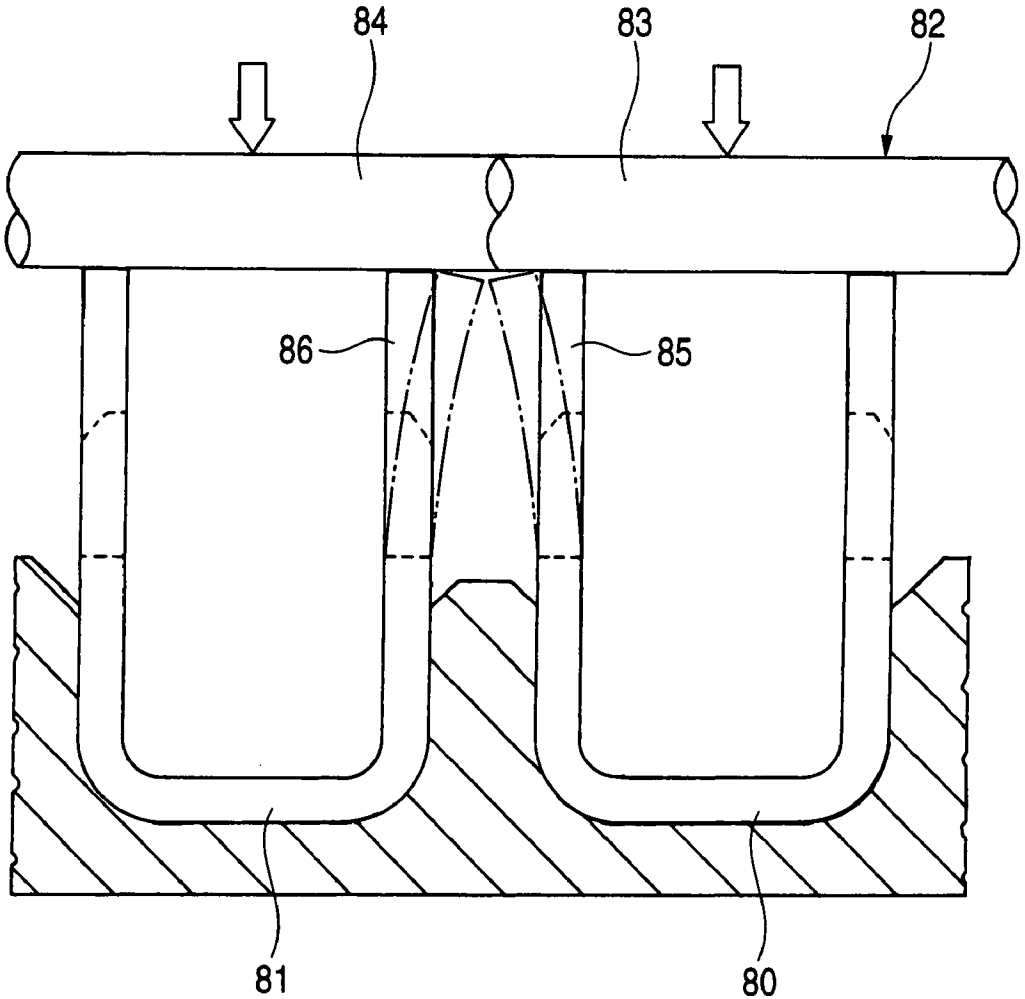
FIG. 5 is a front-elevational view of related press-contacting terminals.

A Preferred embodiment of the present invention will now be described in detail with reference to the drawings. FIG. 1 is a plan view showing a condition in which one preferred embodiment of press-contacting terminals of the invention are mounted within a casing, FIG. 2 is a side-elevational view of FIG. 1, FIG. 3 is a perspective view of the press-contacting terminals of FIG. 1, showing their appearance, and FIG. 4 is a front-elevational view of the press-contacting terminals of FIG. 3.

As shown in FIG. 1, one preferred embodiment of the press-contacting terminal 10 of the invention mainly includes a bottom plate 11, and press-contacting blades 12 each having a wire insertion portion 13. The two press-contacting terminals 10 are mounted within the casing 30.

The bottom plate 11 is flat, and is mounted on a terminal fixing portion 31 formed at the casing 30. An extending end portion of the bottom plate 11 is electrically connected to a control circuit 32 received within the casing 30.

The pair of press-contacting blades 12 are bent perpendicularly at opposite side edges of the bottom plate 11, and extend respectively from these side edges in opposed relation to each other. The wire insertion portion 13 of a predetermined width is formed in a central portion of the press-contacting blade 12 by cutting or stamping, and extends from a distal end of the press-contacting blade 12 toward the bottom plate 11. Therefore, each of the press-contacting blades has a pair of blade portions, which are elongated side by side, and the wire insertion portion 13 that is defined by a space formed between the blade portions. The press-contacting blade 12 has a blade surface 14 at its distal end edge of the blade portion, and a chamfered portion 15 is formed at an outer side (outer edge) of the blade surface 14, which side is opposed to the other press-contacting blade 12. The chamfered portion 15 is inclined with respect to the blade surface 14 and the blade portion.

A flat cable 40 has two wires 41 arranged parallel to each other with a bridge portion 42 lying therebetween, and the press-contacting terminals 10 are arranged on the terminal fixing portion 31 in slightly-offset relation to each other in an upward-downward direction (FIG. 1) in such a manner that the wire insertion portions 13 of the press-contacting blades 12 of one of the press-contacting terminals 10 are disposed in a path of installation of one wire 41, while the wire insertion portions 13 of the press-contacting blades 12 of the other press-contacting terminal 10 are disposed in a path of installation of the other wire 41. In this condition, the inner press-contacting blades 12 of the two press-contacting terminals 10 are disposed close to each other. A cover 33 for pressing the wires 41 of the flat cable 40 against the press-contacting blades 12 is mounted on the terminal fixing portion 31 of the casing 30.

The flat cable 40 is a flexible cable such as an FPC (Flexible Printed Circuit), an FFC (Flexible Flat Cable) and a ribbon cable), and the two wires 41 are formed integrally with each other via the bridge portion 42.

As shown in FIG. 2, ribs 34 are formed at opposite end portions of the terminal fixing portion 31 of the casing 30, and are disposed between the two paths of installation of the wires 41 passing through the press-contacting blades 12. Each rib 34 is disposed between a pair of concave surface portions 35 disposed in alignment respectively with the wire insertion portions 13 in a direction perpendicular to the press-contacting blades 12. The rib 34 has a height in a direction generally toward the wires 41 of the flat cable 40 passing through the press-contacting blades 12, and each rib 34 projects toward the bridge portion 42. Each rib 34 is formed between the two paths of installation of the wires 41 passing through the press-contacting blades 12. Therefore, when the wires 41 are forced into the wire insertion portions 13 of the press-contacting blades 12 and also when the wires 41, thus forced into the wire insertion portions 13, are passed therethrough, the two wires 41 will not interfere with each other, and therefore the two wires 41 are passed through the corresponding wire insertion portions 13 separately from each other. Thus, the interference of the two wires 41 with each other is prevented.

When the flat cable 40 is to be electrically connected to the press-contacting terminals 10, the wire insertion portions 13 of the press-contacting blades 12 of one press-contacting terminal 10 are disposed beneath one wire 41 of the flat cable 40, while the wire insertion portions 13 of the press-contacting blades 12 of the other press-contacting terminal 10 are disposed beneath the other wire 41 as shown in FIG. 3.

When each wire 41 of the flat cable 40 abuts against the corresponding press-contacting blade 12, the wire 41 impinges on the blade surface 14 of the press-contacting blade 12 as shown in FIG. 4. As a result, the chamfered portion 15 receives a stress from the wire 41, so that a force acts on the press-contacting blade 12 in a direction indicated by an arrow. Therefore, the stress acts on the two press-contacting blades 12 of each press-contacting terminal 10 to urge them toward each other, so that the two press-contacting blades 12 will not be deformed outwardly. Therefore, the inner press-contacting blades 12 of the two press-contacting terminals 10 which are disposed close to each other will not contact each other. Then, when each wire 41 is further pressed deeper into the wire insertion portion 13, a sheath 43 (see FIG. 3) is cut, and an exposed conductor 44 (see FIG. 3) is electrically connected to the wire insertion portion 13 of the press-contacting blade 12.

Thus, when each wire 41 is to be forced into the wire insertion portion 13 of the press-contacting blade 12, the wire 41 is brought into abutting engagement with the chamfered portion 15, and this chamfered portion 15 mainly receives a stress from the wire 41, thereby preventing the press-contacting blade 12 from tilting outwardly. Therefore, even when the press-contacting terminals 10 are arranged close to each other, the press-contacting blades 12 of these terminals 10 will not contact each other. And besides, the press-contacting terminal prevents the tilting by itself upon pressing of the wire 41 thereinto, and therefore it is not necessary to form any projection or the like. Thus, the press-contacting terminal can perform the self-tilt prevention function without the need for a complicated structure.

In the press-contacting terminal 10 of this embodiment, when the wire 41 is to be forced into the wire insertion portion 13 of each press-contacting blade 12, the wire 41 abuts against the chamfered portion 15, and therefore the chamfered portion 15 mainly receives a stress from the wire 41, thereby preventing the press-contacting blade 12 from tilting outwardly. Therefore, even when the plurality of press-contacting terminals 10 are arranged close to each other, the adjacent press-contacting terminals will not contact each other. And besides, the press-contacting terminal prevents the tilting by itself upon press-contacting of the wire 41, and therefore it is not necessary to form any projection or the like. Thus, the press-contacting terminal can perform the self-tilt prevention function without the need for a complicated structure.

In the press-contacting terminal 10 of this embodiment, when the wires 41 are forced into the wire insertion portions 13 of the press-contacting blades 12 of the press-contacting terminals 10 mounted on the terminal fixing portion 31, the ribs 34 prevent the wires 41 from interfering with each other, and the wires 41 are passed through the wire insertion portions 13 separately from each other, thereby preventing the interference of the wires 41 with each other. And besides, it is not necessary to form any stamped-out hole or opening to the bridge portion 42 of the flat cable 40, and the press-contacting terminal can be electrically connected to the conductor 44.

The present invention is not limited to the above embodiment, and suitable modifications, improvements and the like can be made. For example, the chamfered portion does not always need to be formed at the outer side of each of the press-contacting blades, but may be formed only at that press-contacting blade which is to be disposed close to an adjoining press-contacting terminal.

The number of the press-contacting terminals to be mounted within the casing is not limited to two, and more than two press-contacting terminals can be provided, even in which case the press-contacting blades, disposed close to each other, are prevented from contacting each other.

The number of the wires of the flat cable is not limited to two, and the flat cable can have more than two wires. In this case, there are prepared the press-contacting terminals corresponding in number to the wires or to those portions of the wires to which the press-contacting terminals are to be electrically connected, respectively.

What is claimed is:

1. A press-contacting terminal apparatus for press-contacting a wire that includes a conductor and a sheath for covering the conductor, the press-contacting terminal apparatus comprising:

a bottom plate; and a pair of press-contacting blades that projects from opposite side edges of the bottom plate to be opposed to each other, at least one of the pair of press-contacting blades comprising, a pair of blade portions that extend upwardly from the bottom plate in a side by side manner so as to define a wire insertion portion therebetween, into which the wire is inserted and electrically connected to the conductor, a blade surface that is formed at an uppermost distal portion of the blade portion, and cuts the sheath when the wire is inserted into the wire insertion portion, the blade surface being inclined toward the wire insertion portion, and a chamfered portion that is formed along an outer portion of the blade surface positioned outside with respect to the bottom plate.

2. The press-contacting terminal apparatus according to claim 1, wherein the distal portions of the pair of blade portion are inclined so as to form a V-shape to receive the wire.

3. The press-contacting terminal apparatus according to claim 1, wherein the chamfered portion is inclined with respect to the blade surface and the blade portion.

4. The press-contacting terminal apparatus according to claim 1, wherein when the blade surface cuts the sheath at the time the wire is inserted into the wire insertion portion, the chamfered portion prevents the press-contacting blade from tilting outwardly.

5. The press-contacting terminal apparatus according to claim 1 further comprising:

a casing that includes a terminal fixing portion on which a plurality of press-contacting terminals are disposed, and a rib that is provided to the terminal fixing portion so as to prevent the wires, which are respectively inserted into the wire insertion portions, from interfering with each other.

6. The press-contacting terminal apparatus according to claim 5, wherein the rib is formed at an end portion of the terminal fixing portion.

7. The press-contacting terminal apparatus according to claim 6, wherein the rib is formed at a portion of the terminal fixing portion between the wire insertion portions.

8. The press-contacting terminal apparatus according to claim 1 further comprising:

a casing that includes a terminal fixing portion on which the press-contacting terminal is disposed; and a cover that is mounted on the terminal fixing portion so as to press the wire to the press-contacting blade.

9. The press-contacting terminal apparatus according to claim 1, further comprising a pair of concave surface portions disposed in alignment with the wire insertion portions in a direction perpendicular to the press-contacting blades.

10. The press-contacting terminal apparatus according to claim 1, wherein the thickness of the blade portion decreases in the longitudinal direction of the wire.

* * * * *